US010017347B2

(12) United States Patent
Peccetti

(10) Patent No.: US 10,017,347 B2
(45) Date of Patent: Jul. 10, 2018

(54) ACCOMPANYING SQUEEZING UNIT IN A WINDING MACHINE FOR PLASTIC FILM

(71) Applicant: COLINES S.P.A., Novara (IT)

(72) Inventor: Eraldo Peccetti, Novara (IT)

( * ) Notice: Subject to any disclaimer, the term of this patent is extended or adjusted under 35 U.S.C. 154(b) by 224 days.

(21) Appl. No.: 15/022,400

(22) PCT Filed: Sep. 19, 2014

(86) PCT No.: PCT/EP2014/002543

§ 371 (c)(1),
(2) Date: Mar. 16, 2016

(87) PCT Pub. No.: WO2015/043733

PCT Pub. Date: Apr. 2, 2015

(65) Prior Publication Data

US 2016/0251188 A1 Sep. 1, 2016

(30) Foreign Application Priority Data

Sep. 25, 2013 (IT) ..... MI2013A1579

(51) Int. Cl.
*B65H 19/22* (2006.01)
*B65H 19/29* (2006.01)

(52) U.S. Cl.
CPC ..... *B65H 19/29* (2013.01); *B65H 19/2207* (2013.01); *B65H 2404/433* (2013.01); *B65H 2701/1752* (2013.01)

(58) Field of Classification Search
CPC ..... B65H 19/29; B65H 19/2207; B65H 2701/1752; B65H 2404/433
See application file for complete search history.

(56) References Cited

U.S. PATENT DOCUMENTS 4,431,140 A * 2/1984 Tetro ..... B65H 19/2215 242/527.3
4,524,919 A * 6/1985 Wehrmann ..... B65H 18/16 242/533.5
4,529,141 A * 7/1985 McClenathan ..... B26D 1/425 242/527.1
4,541,583 A 9/1985 Forman et al.
5,018,679 A 5/1991 Saiga et al.
5,035,373 A * 7/1991 Perrigo ..... B65H 18/26 242/413.3

(Continued)

FOREIGN PATENT DOCUMENTS

GB 1092601 A 11/1967

*Primary Examiner* — William A. Rivera
(74) *Attorney, Agent, or Firm* — Themis Law

(57) ABSTRACT

An accompanying squeezing unit in a machine for winding plastic film onto bobbins, in which at least two spindles are positioned on a rotating plate around a central shaft constrained to an upright of the machine, the group including an accompanying squeezing roll situated on a lever mechanism which is selectively actuated to rotate-oscillate by actuators in order to maintain the squeezing roll positioned on a film in the final winding onto a bobbin positioned on one of the spindles, the lever mechanism being activated when the plate carrying the spindles is rotated to discharge a finished bobbin. The lever mechanism in the group includes two first levers and two second levers articulated relative to each other.

6 Claims, 5 Drawing Sheets

(56) References Cited

U.S. PATENT DOCUMENTS

| | | | | |
|---|---|---|---|---|
| 5,054,707 | A * | 10/1991 | Olson | B65H 19/2215 242/533.5 |
| 5,660,351 | A | 8/1997 | Osanai | |
| 6,273,357 | B1 * | 8/2001 | Figge | B21C 47/245 242/533.4 |
| 8,459,586 | B2 * | 6/2013 | Vaughn | B65H 19/2207 242/533.3 |

* cited by examiner

ACCOMPANYING SQUEEZING UNIT IN A WINDING MACHINE FOR PLASTIC FILM

The present invention relates to an accompanying squeezing unit in a machine for winding plastic film onto bobbins.

Current machines for winding plastic film onto bobbins envisage reels carrying spindles that effect the winding of plastic film into the desired final bobbins.

The necessity of effecting extremely rapid bobbin-change cycles during the formation of these bobbins, implies the need for using particular types of reels.

The concept of a "revolver" arrangement of the reels i.e. a series of reels (typically 3, but also 2 or 4 or more) has in fact been asserted. These reels are assembled equidistant from a common absolute rotation center and the plastic film produced by the line is alternatingly wound onto the spindles of these reels.

Only with this type of winding concept, is it possible to guarantee extremely rapid bobbin-change cycles, sometimes less than 20 seconds. It should be noted that a bobbin change is necessary whenever the length of the film wound onto the spindle of the reel has reached the prearranged value, so as to have the desired weight or diameter of the bobbin obtained.

The same functioning concept of the "revolver" system implies abandoning, during the bobbin-change phase, the contact with a pressing cylinder of the film being wound, suitably envisaged.

This pressure cylinder of the film being wound acts on the surface of the bobbin and has a double function.

First of all, it must prevent the entry of an excessive quantity of air between the consecutive coils of the bobbin being wound.

Secondly, it must prevent the possibility of the above-mentioned coils "sliding" onto each other, specifically due to the reduction in friction caused by the presence of air which has remained entrapped.

The abandoning of the contact, during the bobbin-change phase, with said cylinder on the part of the bobbin being wound, causes a loss in its functions, with a consequent deterioration in the final appearance of the finished bobbin (presence of air between the coils and imperfect side alignment). This situation does not jeopardize the functionality of the film, but the presence of these geometrical defects, specifically in the final winding phase, i.e. the part which remains visible to the user, causes a "depreciation" of the bobbin.

A general objective of the present invention is to solve the above-mentioned drawbacks of the known art, in an extremely simple, economical and functional way.

A further objective of the present invention is to provide an accompanying squeezing unit in a machine for winding plastic film onto bobbins, which avoids the possibility of entraining air during the rotation of the spindle of the reel with respect to the absolute rotation centre of the reels of the machine.

Yet another objective of the present invention is to provide a squeezing unit which, while solving the above drawbacks, does not slow down the functioning of the machine and the bobbin change.

In view of the above objectives, according to the present invention, an accompanying squeezing unit of a winding machine of plastic film onto bobbins has been conceived, having the characteristics specified in the enclosed claims.

The structural and functional characteristics of the present invention and its advantages with respect to the known art will appear even more evident from the following description, referring to the enclosed drawings, which show an embodiment of an accompanying squeezing unit of a winding machine of plastic film onto bobbins, produced according the invention.

Figure 1:
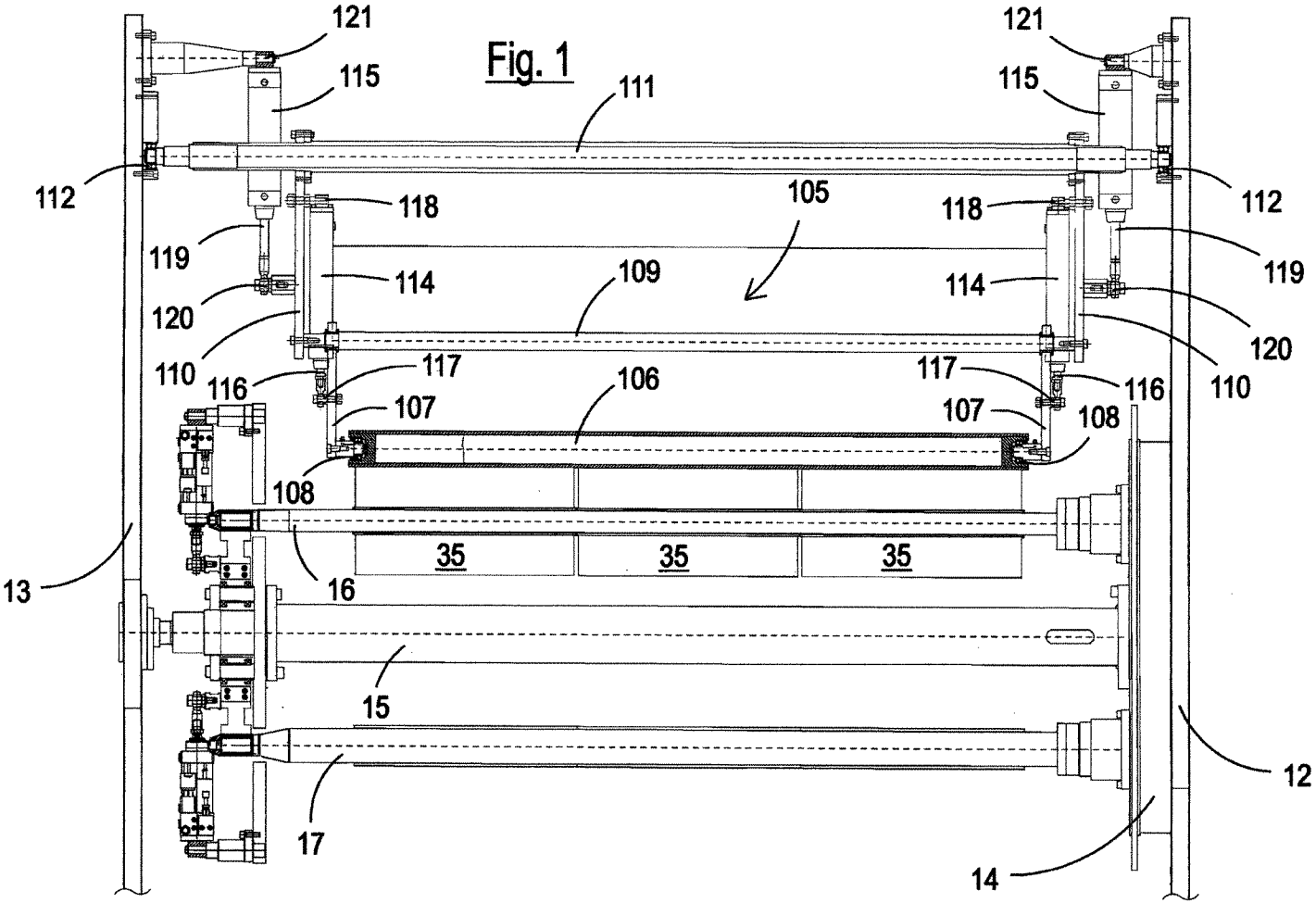
FIG. 1 is a schematic front raised view of a winding machine of plastic film onto bobbins, equipped with an accompanying squeezing unit of plastic film produced according to the invention.

With reference first of all to FIG. 1, this illustrates a schematic view of a raised front view of a winding machine of plastic film onto bobbins equipped with an accompanying squeezing group of plastic film produced according to the invention, indicated as a whole with 105.

This accompanying squeezing group of plastic film 105, is positioned inside the structure consisting of two vertical uprights 12, 13 which form the shoulder of a frame of the winding machine.

A first upright 12 carries cantilevered, on a rotating supporting plate 14, a central shaft 15, supported at the other end by the second upright 13.

The plate 14, rotating around the central shaft 15, also carries three spindles 16, 17 and 18, positioned at 120° with respect to each other, which complete the winding reel. In the example shown, the total number of reels is equal to 3, but can generally vary from 2 to 4 or more.

Figure 2:
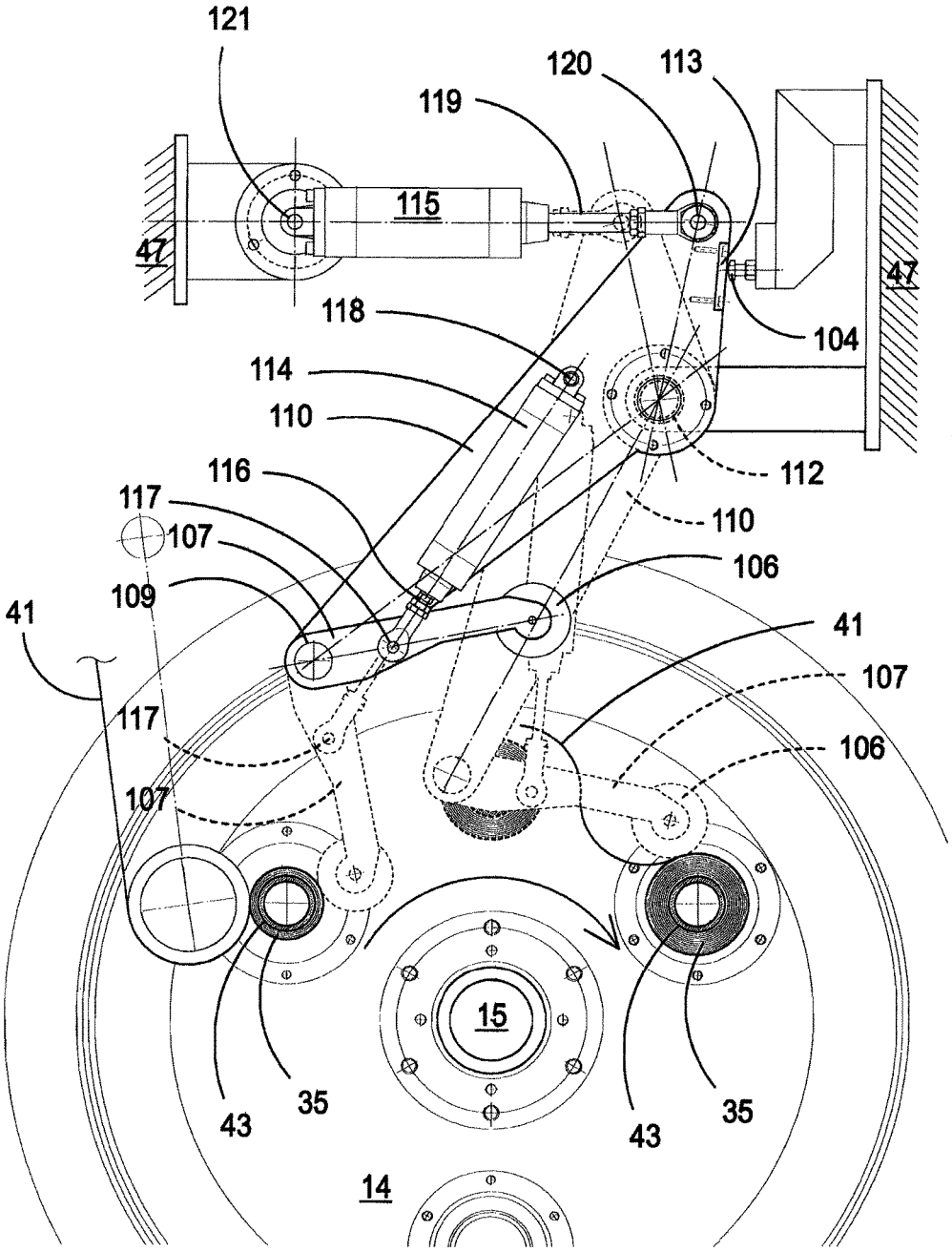
FIG. 2 is a raised side view showing the positions of some of the various elements forming the accompanying squeezing group of plastic film of the present invention, of which some elements are shown in different operational positions.

FIG. 2 shows a raised side view illustrating some of the various elements forming the accompanying squeezing unit of plastic film 105 of the invention, some of which are shown in different positions.

This squeezing group 105 of the invention has in fact been specifically envisaged for avoiding the capturing of air on the part of a plastic film 41 of bobbins 35 being wound, arranged on a spindle 16.

The squeezing group 105 comprises an accompanying squeezing roll 106 (in the example, idle, but it can also be motorized) positioned at the end of a lever mechanism selectively actuated for maintaining the squeezing roll 106 on the film 41 in the final winding onto a bobbin 35 situated on a spindle 16, for example. This action must be effected when the plate 14 carrying the spindles, is rotated in order to discharge a finished bobbin.

According to the example, the lever mechanism consists of an arrangement of articulated levers, commanded to rotate-oscillate by means of respective actuators.

In particular, according to the example shown, the lever mechanism carrying the squeezing roll 106 is produced as follows. The squeezing roll 106 is positioned on first free ends of two first levers 107 with the interpositioning of bearings 108 (FIG. 1). The two first levers 107 are parallel to each other and spaced from each other, at the two extreme sides of the squeezing roll 106.

The two first levers 107 at the second ends are connected by means of a small shaft or pins 109 to further two second levers 110, in turn connected by means of a small shaft 111 supported by bearings 112 on a frame 47 of the machine, partially schematized with interposed supporting elements, to complete the lever mechanism.

The two second levers 110 have a shaped form at one end where a buffer or abutment surface 113 is created for an adjustable stop 104, such as a screw, positioned with respect to a portion of frame 47 (FIG. 2).

The presence of said abutment 113 and of the relative adjustable stop 104 is necessary when the star-shaped plate of the machine must have the possibility of winding onto spindles of reels having different external diameters (typically 2" and 3", but also larger, smaller or intermediate dimensions, with respect to those mentioned). In order to have the possibility of reducing the run of the levers 107 and 110 to the minimum (consequently reducing the changing times which, as can be seen, are fundamental in this type of application), said levers must be positioned as close as possible to the spindle of the winding reel, at the same time obviously avoiding any interference with the same.

Each of the two first levers 107 and the other two second levers 110, is moved in oscillation between an operating position and a discharging position by a pair of actuators 114 and 115, respectively, each consisting, for example, of a single-acting (simple-effect) pneumatic cylinder.

More specifically, the actuators 114 of the two first levers 107, in the example, cylinders, are positioned at one end of one of their stems 116 connected by means of pins 117 in an intermediate area with respect to the first levers 107. The bodies of the cylinders 114, on the other hand, are connected by means of pins 118 in an intermediate area with respect to the second levers 110.

The actuators 115 of the two second levers 110, in the example cylinders, are positioned at one end of one of their stems 119 connected by means of pins 120 in an end area of the second levers 110. The cylinders 115, on the other hand, are connected by means of pins 121 to a portion of the frame 47 of the machine.

It should be pointed out that both the first levers 107 and the second levers 110 are caused to rotate, or better to reciprocally oscillate by means of the respective actuators 114, 115. This is effected in order to maintain the squeezing roll 106 of the group, produced according to the invention, in contact with a bobbin 35 in final winding onto a spindle 16 among the spindles 16, 17, 18 of the winding machine. This action must be effected during the rotation of the plate 14 carrying the spindles (in the example 16, 17, 18,) towards a bobbin- discharge position.

FIGS. 3 to 7 show, in fully schematic views, some operational phases of the squeezing group 105 of the invention.

These figures, in fact, represent a typical condition of a changing sequence of a "revolver" winding group which, in the example, is said to consist of three reels with respective spindles 16, 17 and 18. The sequence clearly shows how, for the whole period between the starting of the rotation of the rotating plate 14, carrying the spindles 16, 17 and 18, around the central shaft 15, and the arrival in the final position, a contact is created between the bobbin and tail of the film, before being cut. In this way, any possible incorporation of air in the bobbin that is to be completed, before being discharged from the respective spindle, is avoided.

Figure 3:
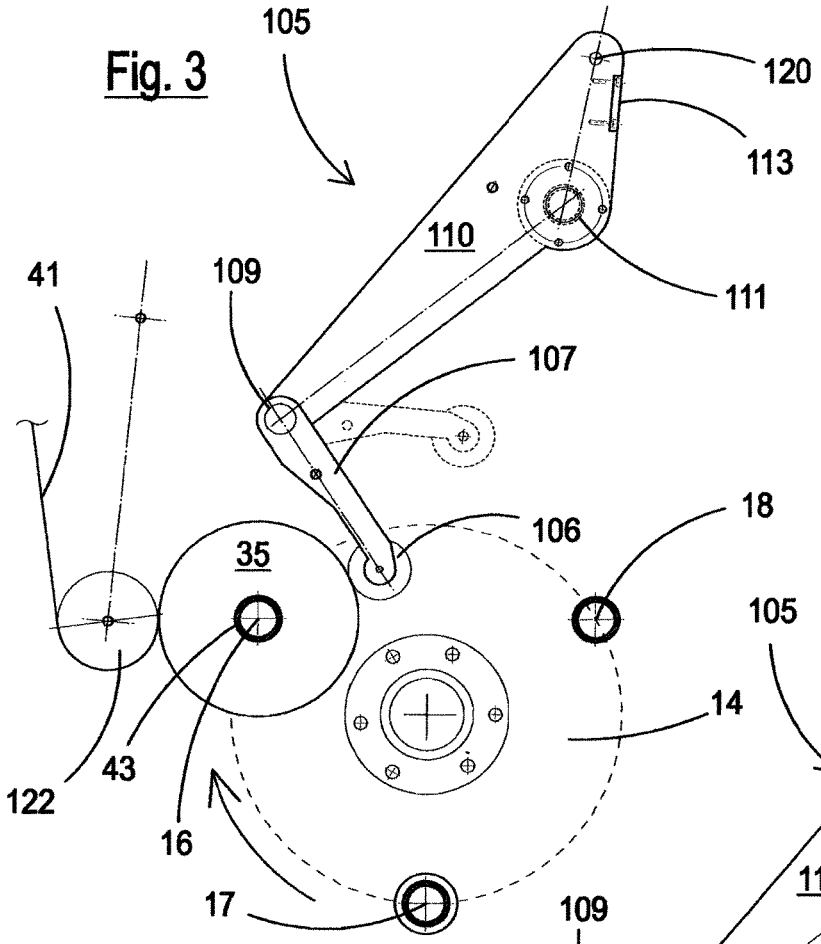
FIGS. 3 to 7 show fully schematic views of some operational phases of the accompanying squeezing group of the present invention.

With reference first of all to FIG. 3, this represents a normal winding phase in which the squeezing roll 106 is kept in contact with the bobbin 35, whereas a normal pressure-winding roll 122 guides the film 41 to be wound around a core 43 positioned on the spindle 16 for forming the bobbin 35.

In order to have this arrangement, the stems 116 and 119 of the cylinders 114 and 115 are at least partially extended.

This is what happens at the beginning of the changing cycle.

Figure 4:
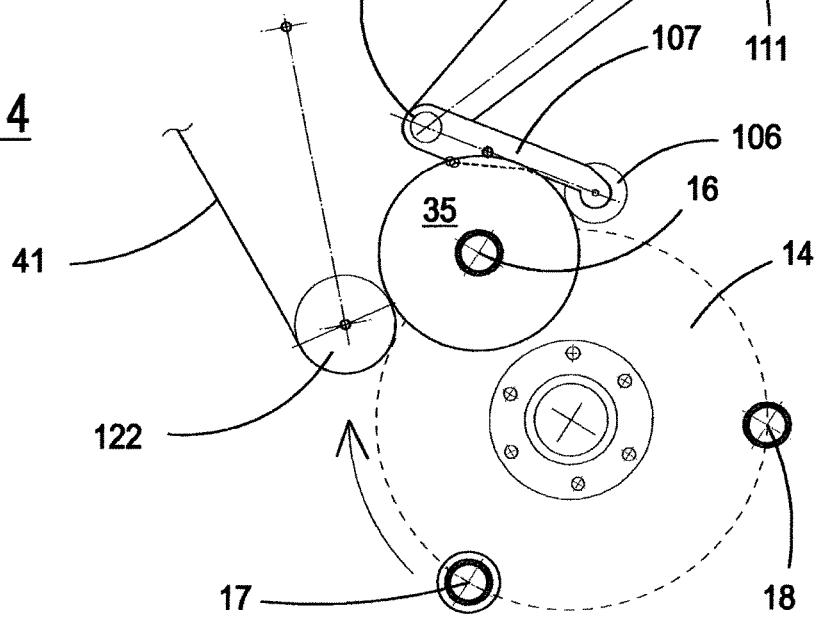

FIG. 4 shows an immediately subsequent phase in which the plate 14 starts rotating around its center defined by the shaft 15.

In this phase, the squeezing roll 106 prevents the entrapment of air in the bobbin 35, which would otherwise take place due to the loss of contact with the pressure-winding roll 122 with the same bobbin 35. This movement of the squeezing roll 106 is enabled by the rotation of the first levers 107 caused by the action of the respective cylinders 114, whereas the second levers 110 can still remain stationary. This obviously also takes place in relation to the geometry of the lever mechanism thus produced by the two pairs of levers 107 and 110, and also by the respective hinging.

Figure 5:
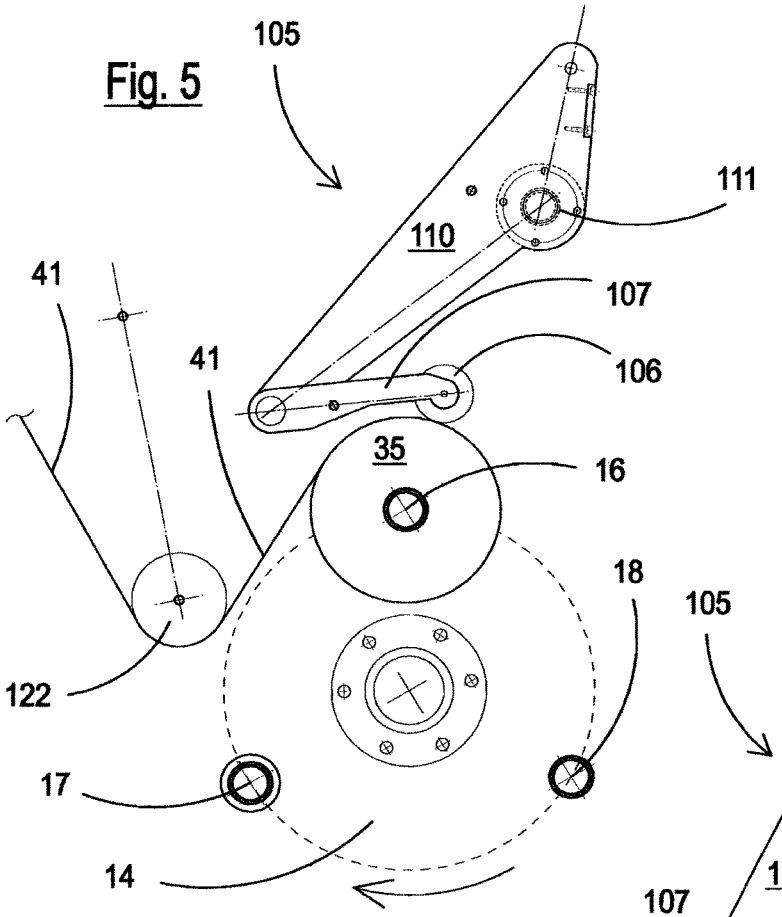
Figure 6:
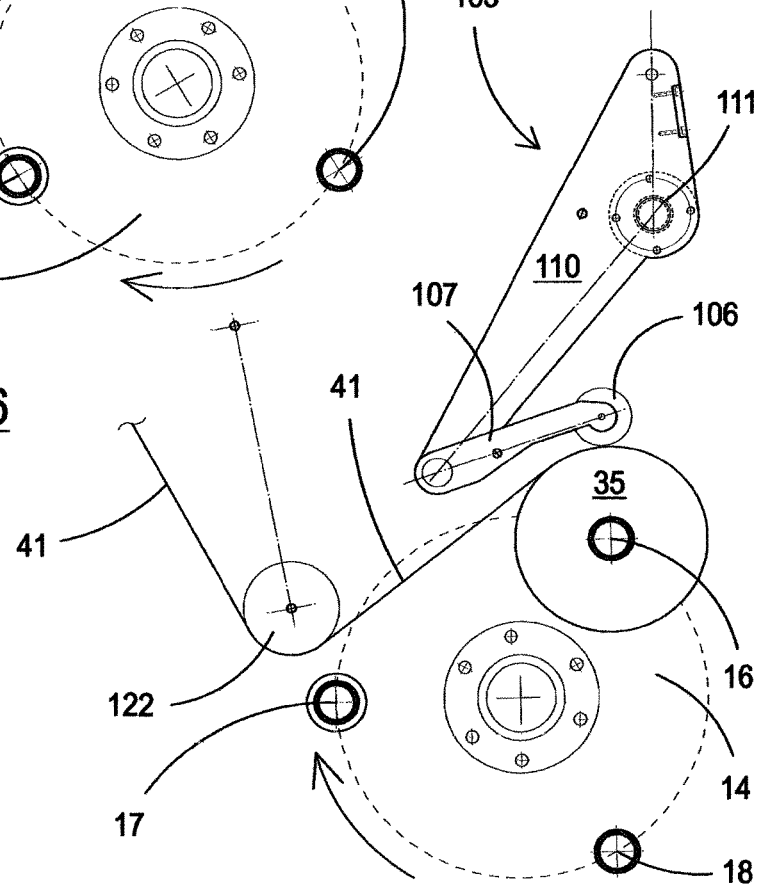

FIG. 5 shows a subsequent phase in which the continued rotation of the plate 14 causes an absolute detachment of the pressure-winding roll 122 from the bobbin 35. It is therefore clearly evident that the absence of the entrainment of air is only due to the presence of the squeezing group of the invention. The squeezing roll 106, in fact, thanks to the presence of the two pairs of levers 107 and 110 and respective cylinders 114 and 115 which suitably move them, remains "stuck" to the surface of the bobbin 35. This contact also keeps the film 41 "stuck" to the outer surface of the bobbin, without any intrusion of air between film and bobbin.

FIG. 6 is again a further rotation phase of the plate 14 and yet another adaptation phase of the squeezing roll 106 with a variation in the position of the spindle 16 carrying the bobbin 35.

Figure 7:
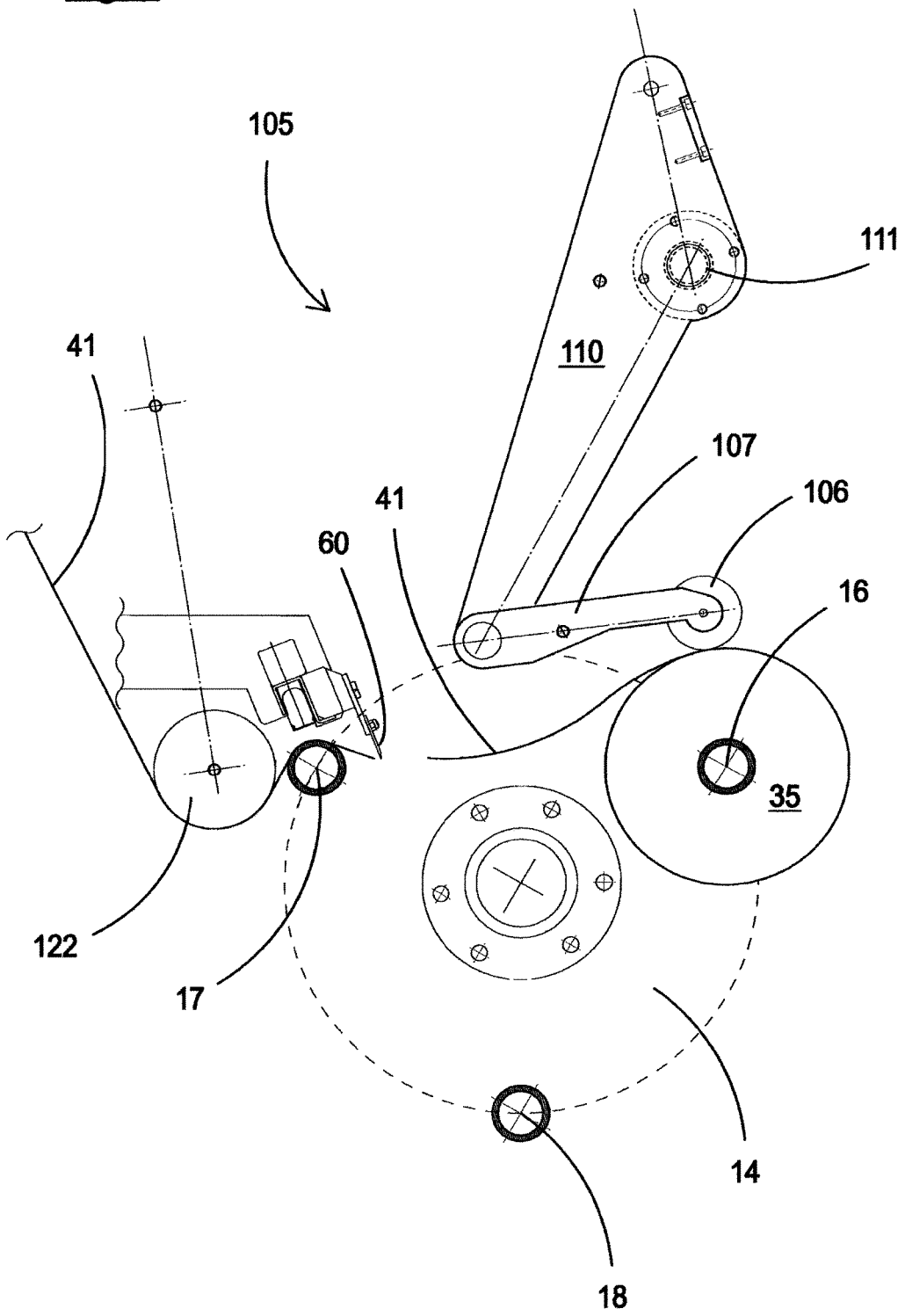

FIG. 7 shows the situation when the bobbin 35, or rather the film 41 still leaving the bobbin as a tail, must be cut by a specific transversal cutting blade 60 of the film 41, which is part of a cutting device present on the winding machine.

The presence of the squeezing roll 106 forming part of the squeezing unit according to the invention, also guarantees in this last phase that the air is not even entrapped by the tail of the film 41.

It can also be seen from some of the phases illustrated and described, how, beyond a certain rotation angle of the plate, which depends on the number of spindles on the plate and its dimension, in addition to the geometry of the lever mechanism of the accompanying squeezing group, the rotation is effected of the second levers 110, or the first levers 107, again driven by the respective actuators 115 and 114, to accompany the bobbin 35 as far as the cutting position of the film 41.

FIG. 2 shows, in both a continuous and dashed line, the possibility of movement of the first and second levers 107 and 110.

At the end of the transversal cutting of the film 41, the first and second levers 107 and 110 return to their initial rest position, ready to bring the accompanying squeezing roll 106 towards the subsequent new bobbin 35 carried by a subsequent spindle 17 in the next changing cycle.

According to the present invention, therefore, the squeezing group advantageously prevents the entrainment of air between subsequent coils of film during the bobbin-change phase.

It is in fact evident that during a bobbin-change sequence in a winding group of the "revolver" type, during the whole period between the starting of the rotation of the revolver reel group (i.e. the rotating plate 14) around its rotation axis (the shaft 15) and arrival in the final position, the contact between a core 43 of the bobbin 35 and subsequently the bobbin 35 being formed and wound with the squeezing roll 106 of the group of the invention, is guaranteed. In this way, there can be no entrainment of air in the bobbin 35.

The bobbins thus obtained are consequently perfectly wound and their subsequent coils are well aligned and compact, obtaining a high-quality bobbin.

The objective mentioned in the preamble of the description has therefore been achieved.

The forms of the structure for producing a group of the invention, as also the materials and assembly modes, can obviously differ from those shown in the drawings for purely illustrative and non-limiting purposes.

The protection scope of the invention is therefore delimited by the enclosed claims.

The invention claimed is:

1. An accompanying squeezing unit in a machine for winding plastic film onto bobbins, in which at least two spindles are positioned on a rotating plate around a central shaft constrained to an upright of the machine, comprising:

an accompanying squeezing roll situated on a lever mechanism which is selectively actuated to rotate-oscillate by actuators in order to maintain the accompanying squeezing roll positioned on a film in a final winding onto a bobbin positioned on one of said spindles, said lever mechanism being activated when said rotating plate carrying said spindles is rotated to discharge a finished bobbin, wherein said lever mechanism comprises two first levers and two second levers, wherein said first levers at first free ends support said accompanying squeezing roll and are spaced from and adjacent to each other, and at second ends, are hinged to ends of said second levers, and wherein said ends of said second levers are spaced from and adjacent to each other and hinged to a frame of the machine.

2. The accompanying squeezing unit according to claim 1, wherein said actuators are positioned, a first one between said first and second levers, and a second one, between said second levers and said frame of the machine.

3. The accompanying squeezing unit according to claim 1, wherein said two second levers have a shaped form at one end, and wherein an abutment or buffer surface is defined at said end of said shaped form to receive an adjustable stop positioned in a portion of the frame.

4. The accompanying squeezing unit according to claim 1, wherein each of said actuators comprises a simple-effect pneumatic cylinder.

5. The accompanying squeezing unit according to claim 1, wherein said accompanying squeezing roll is an idler roll.

6. The accompanying squeezing unit according to claim 1, wherein said accompanying squeezing roll is a motorized roll.

* * * * *